US005499662A

United States Patent [19]

Vogel et al.

[11] Patent Number: 5,499,662

[45] Date of Patent: Mar. 19, 1996

[54] METHOD FOR PREVENTING THE FORMATION OF FABRIC BLEMISHES BY CONTROLLING BEAT-UP IN A LOOM

[75] Inventors: Rudolf Vogel, Grüt, Switzerland; Hüsnü Evren, Erenköy/Istanbul, Turkey

[73] Assignee: Sulzer Rueti AG, Rueti, Switzerland

[21] Appl. No.: 322,000

[22] Filed: Oct. 12, 1994

[30] Foreign Application Priority Data

Oct. 14, 1993 [EP] European Pat. Off. ..... 93810723

[51] Int. Cl.[6] ..... D03D 1/00; D03D 49/60; D03D 39/22

[52] U.S. Cl. ..... 139/26; 139/116.2

[58] Field of Search ..... 139/1 R, 116.2, 139/25, 26, 188 R, 370.2

[56] References Cited

U.S. PATENT DOCUMENTS

| | | | |
|---|---|---|---|
| 3,695,302 | 10/1972 | Jud | 139/27 |
| 4,566,498 | 1/1986 | Williams | 139/26 |
| 5,058,628 | 10/1991 | Spiller et al. | 139/25 |
| 5,224,520 | 7/1993 | Shinbara et al. | 139/116.2 |
| 5,404,916 | 4/1995 | Mueller et al. | 139/116.2 |

FOREIGN PATENT DOCUMENTS

| | | | |
|---|---|---|---|
| 0350446 | 1/1990 | European Pat. Off. . | |
| 0523581A1 | 1/1993 | European Pat. Off. . | |
| 4137681A1 | 5/1992 | Germany . | |
| 2154029 | 6/1990 | Japan | 139/26 |

OTHER PUBLICATIONS

Patent Abstracts of Japan, vol. 14, No. 435 (C–0760) Sep. 18, 1990 and JP–A–02 169 749 (Tsudakoma) Jun. 29, 1990.

*Primary Examiner*—Andy Falik

*Attorney, Agent, or Firm*—Townsend and Townsend and Crew

[57] ABSTRACT

A method for weaving blemish-free smooth and terry fabric on a loom following a stoppage of the loom after it has woven a fabric fell which terminates in a last weft thread. The loom has a driven reed which reciprocates during normal weaving towards and away from the fell over a predetermined beat-up distance to successively position additional weft threads at predetermined target positions which assure a uniform, blemish-free fabric. Following a loom stoppage, the next weft yarn, for smooth fabric, and a plurality of next weft yarns, for terry fabric, are moved towards the last weft yarn over a compensated beat-up distance which is different from the predetermined beat-up distance to thereby position the next weft yarn at the desired target position relative to the least weft yarn of the fell to avoid the formation of fabric blemishes. Thereafter the reed is again moved over the predetermined beat-up distance during subsequent picks of the loom.

8 Claims, 4 Drawing Sheets

METHOD FOR PREVENTING THE FORMATION OF FABRIC BLEMISHES BY CONTROLLING BEAT-UP IN A LOOM

BACKGROUND OF THE INVENTION

The invention concerns a method for controlling the beat-up in a loom, the reed being set to a target or desired beat-up distance.

Various alternatives are known for regulating the fell of the cloth in the loom to avoid start-up marks or blemishes in the fabric.

EP-A-350 446 discloses a method for operating a terry loom in which the sley is driven by the main drive of the loom and is actuated by a separate drive which is controlled, individually for each weft, by a series of freely programmable pulses. In this way the known terry rhythms with different pile heights can be executed.

SUMMARY OF THE INVENTION

It is an object of the invention to create a method for controlling the reed beat-up in a loom which avoids the formation of thick and/or thin areas in the fabric by varying the beat-up distance of the reed.

This object is achieved in accordance with the invention by reciprocating the reed over a predetermined beat-up distance towards and away from the fell during normal operation of the loom to beat-up the weft threads against the fell. Following a loom stoppage, the next weft yarn is beat-up against the last weft yarn over a compensated beat-up distance which is different from the predetermined beat-up distance. Thereafter the reed is again reciprocated over the predetermined beat-up distance during subsequent picks of the loom.

An advantage derived from the invention is that terry fabric and smooth fabric are manufactured which have the desired, pre-programmed uniform weft density so that the formation of fabric blemishes is prevented.

DETAILED DESCRIPTION OF THE PREFERRED EMBODIMENTS

The method of the present invention is used to avoid weaving faults, the course of the method being dependent on whether a weft thread fault, e.g. a weft thread breakage, part weft, etc., or another stop event, e.g. warp thread breakage, switching-off of the loom, etc., occurred.

Figure 1:
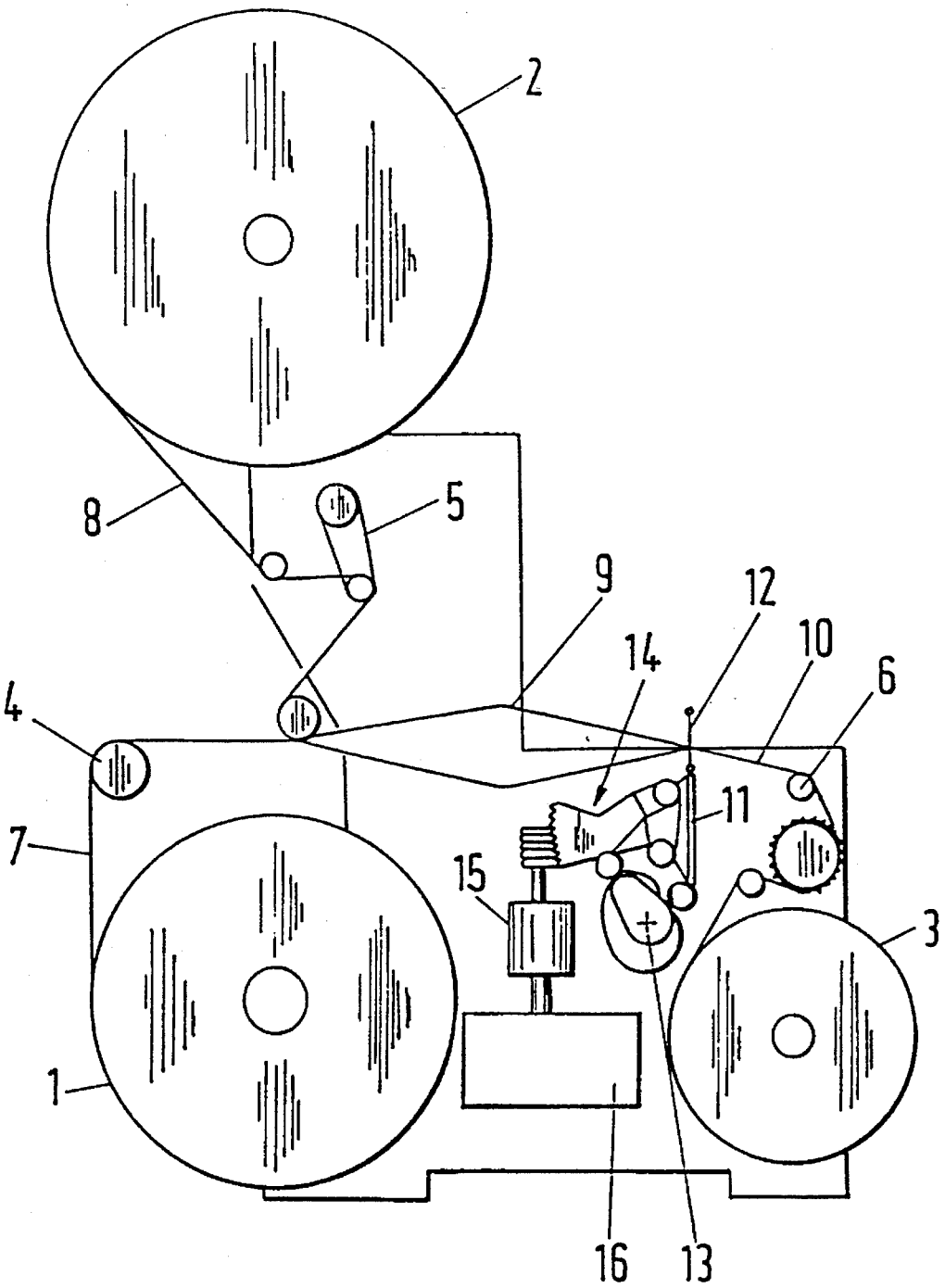
FIG. 1 is a side view of a terry loom using the method of the present invention.

FIG. 1 shows a terry loom for carrying out the method of the present invention. A ground warp 7 runs from a ground warp beam 1 via a tensioning beam 4 to a shed 9. A fabric 10 is drawn off via a breast beam 6 and a take-off roller onto a cloth beam 3. A pile warp 8 is led from a pile warp beam 2 to shed 9 via an oscillating roller 5. A reed 12 of a sley 11 is driven by a loom main drive shaft 13 via a sley control means 14. Furthermore, a servomotor 15 is provided which is drivingly connected with the sley control means in order to set the beat-up distances. The servomotor 15 is connected electrically with a control means 16 in order to drive the servomotor 15 in accordance with a control program.

In the following, one embodiment of the method is described, which is applied during the weaving of three weft terry fabric.

Figure 2:
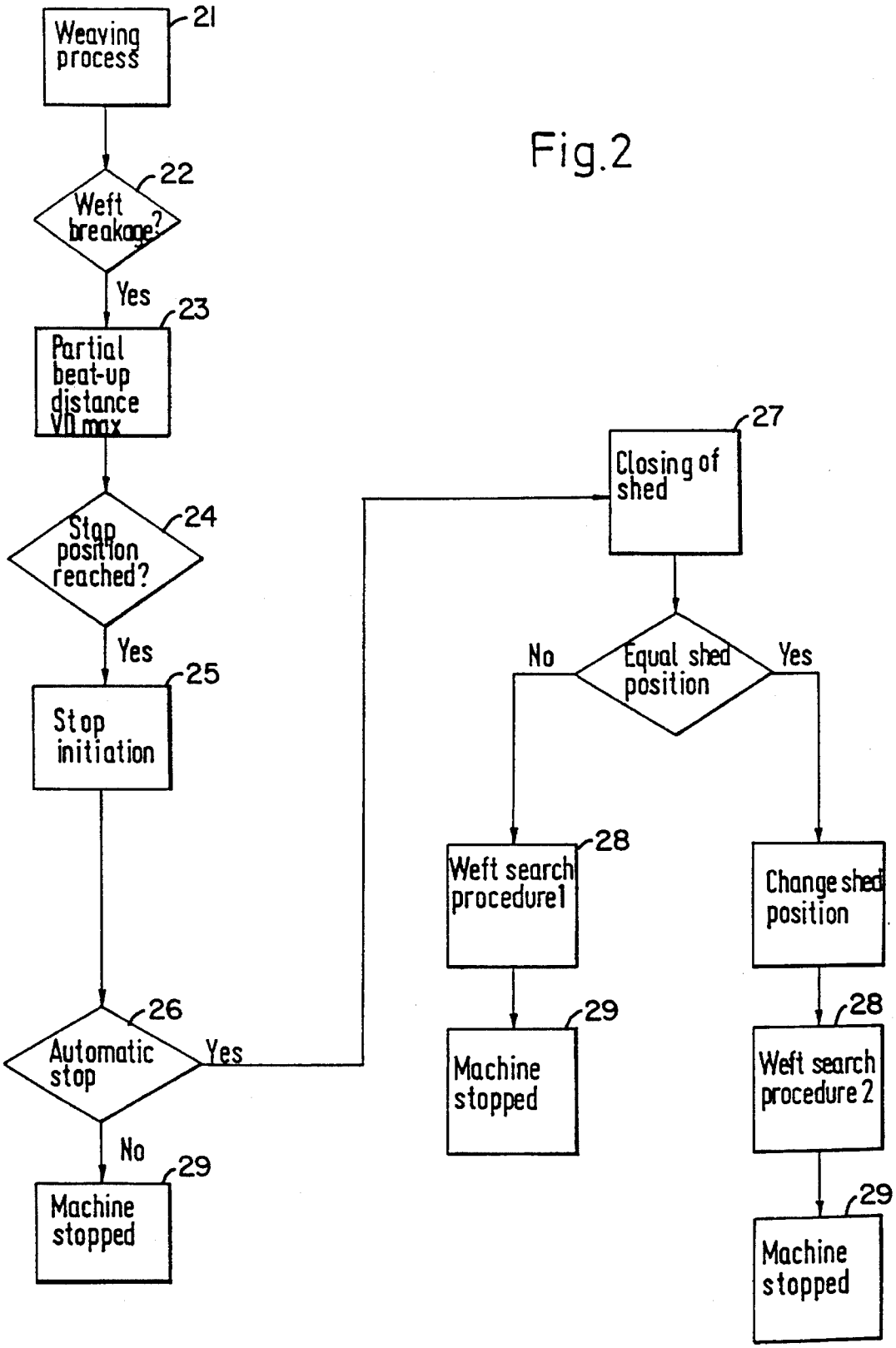
FIG. 2 is a flow diagram of the course of the method for shutting down the machine when a mispick or weft fault occurs.

FIG. 2 is a flow diagram and shows what happens when a weft thread breakage occurs during weaving 21. The appropriate monitoring means 22 sends a fault signal to the control means 16 which, in one control step, sets the sley control means 14 by means of the servomotor 15 to a partial beat-up distance 23 VD, VD being at least so much greater than $VD_{target}$ or $AD_{target}$ that the reed and a part weft which might be present no longer alters the position of the previously correctly inserted weft thread, i.e. a minimal distance from the previously correctly introduced weft thread is present. At this time, the main shaft of the loom turns until a stop position 24 is reached, at which a control step stop initiation 25 takes place. In the event that an automatic stop 26 of the loom is initiated, the main shaft is turned in the direction of motion in order to reach a predetermined shed position, for example the closed shed position 27. Subsequently, a control step weft search is initiated which, in dependence on the shed position, comprises two independent search processes 28. After completion of the appropriate search process, the loom is shut down at 29.

Figure 3:
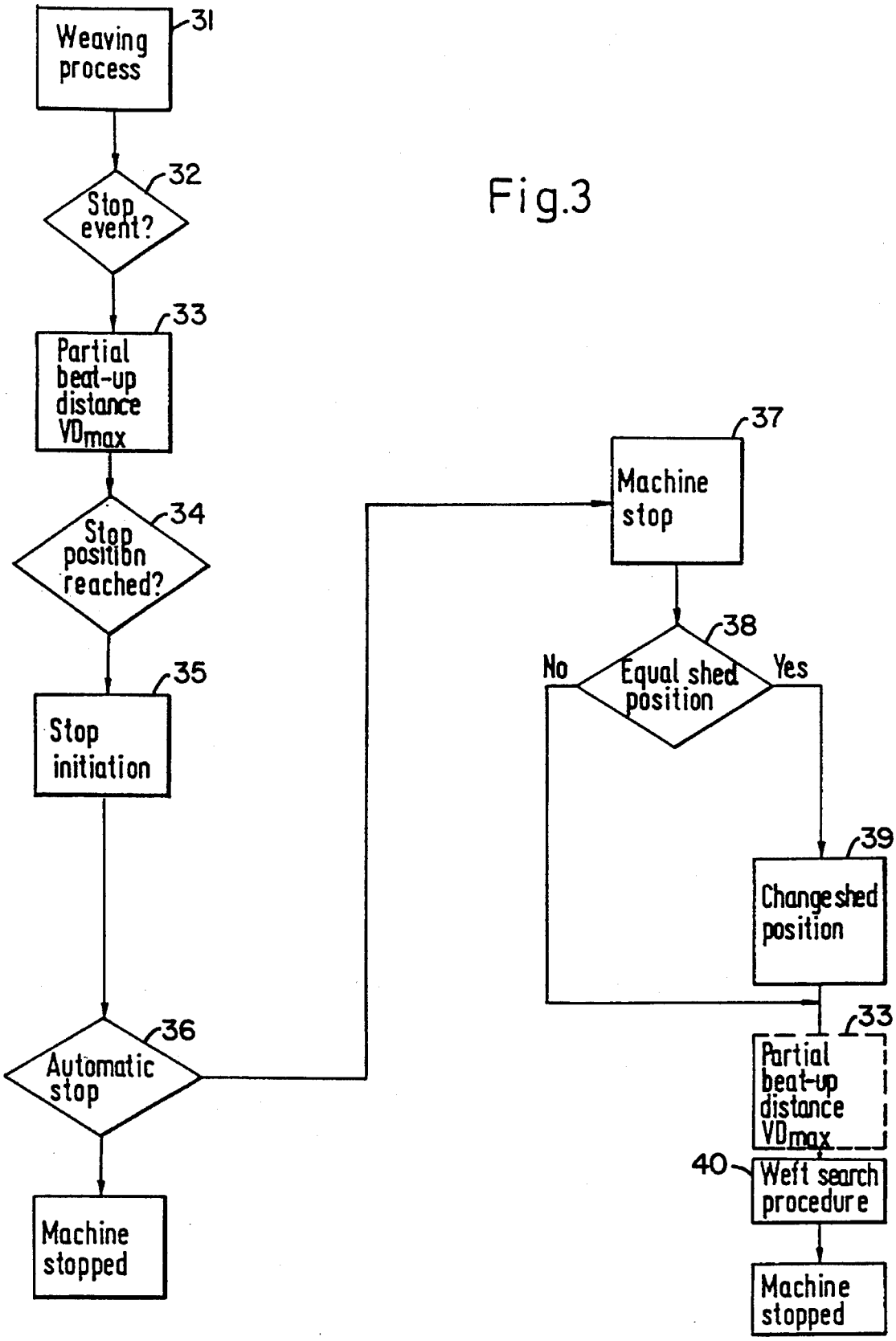
FIG. 3 is a flow diagram of the course of the method for shutting down the machine when a stop event occurs.

Referring now to FIG. 3, if another stop event 32, for example a warp thread breakage, a manual switch-off etc., occurs during the weaving process 31, the sley control means can, according to the invention, be set, by means 33 of the servomotor, to the partial beat-up distance $VD_{max}$ either directly after the stop event or before the reed reaches the full beat-up position a further time.

In the same way as in the case of a weft thread breakage, the second control step "stop initiation" 35 follows after the stop position 34 has been reached. If an automatic stop 36 is initiated, a control step "machine stop" 37 follows. If an equal positioning 38 of the shed is desired, the shed position is altered 39 in one control step. After the alteration of the shed position, or in the case of an unequal shed position, a control step "weft search" 40 is initiated. After completion of the weft search process, the loom is shut down and, after the fault has been rectified, it is prepared for restarting (FIG. 3).

In the control means 16 (FIG. 1) the characteristic values target partial beat-up distance, target full beat-up distance, weft density, number of terry picks until the full beat-up and fabric type are stored. Furthermore, a correction procedure can be stored as a function of these characteristic values, which determines the correction steps. It is pointed out that further characteristic values can be taken into account.

Furthermore, it is provided that the correction procedure can be input manually, independently of the stored characteristic values, in which case account can be taken of special features of the article being woven.

In doing this, the values of the partial beat-up distance and of the full beat-up distance are corrected when the loom is restarted. This correction takes place stepwise on the basis of correction steps which can be set manually and which are assigned to every beat-up and are repeated until the target beat-up distance for the partial beat-up weft and the full beat-up weft is reached. The correction can take place within one or several groups of picks. Here, the length change of the beat-up distance can be the same or different for each group or for each beat-up.

Figure 4:
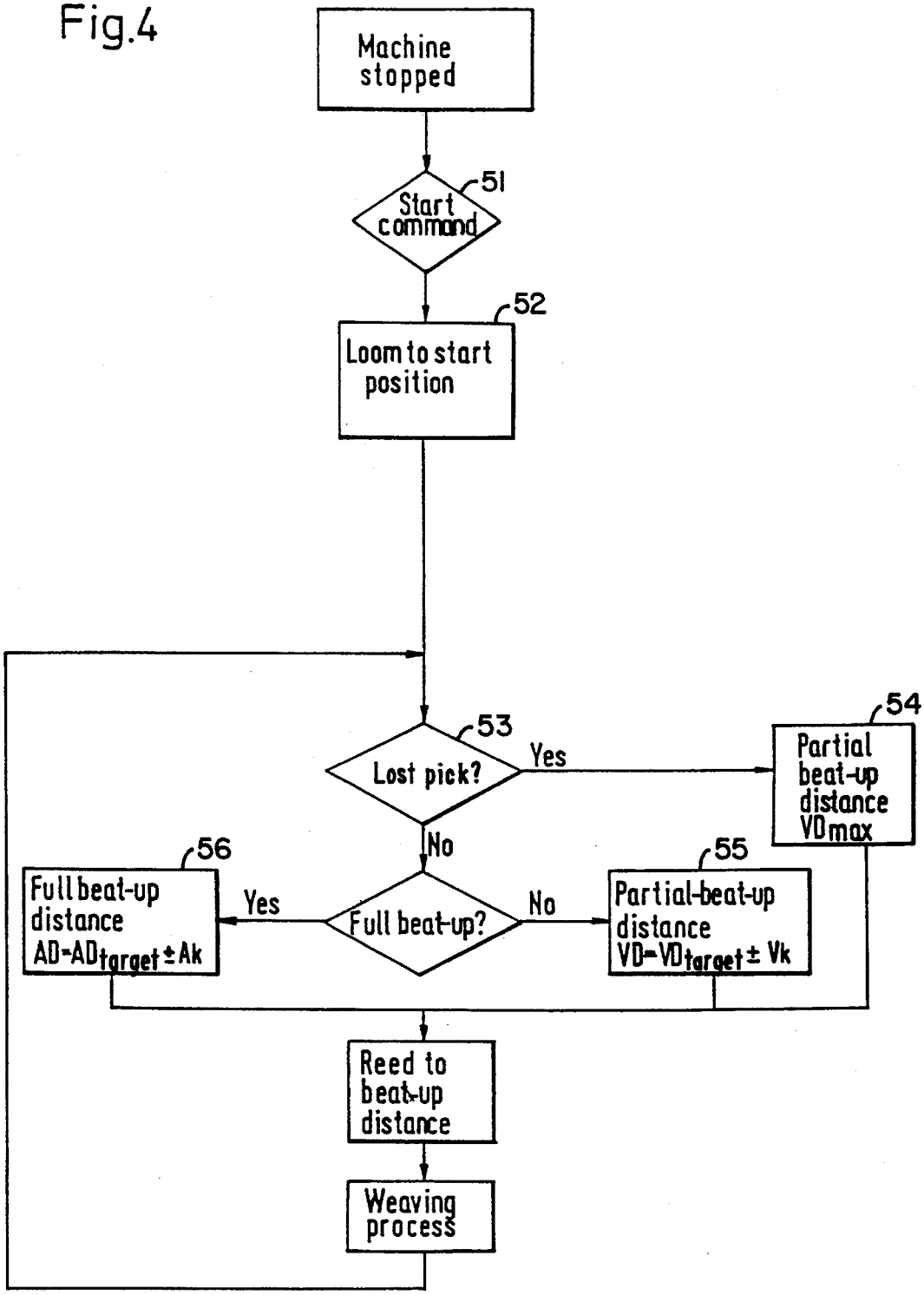
FIG. 4 is a flow diagram of the course of the method for restarting the machine.

Referring to FIG. 4, restarting of the machine is initiated, as a rule, with a manually triggered start command 51. In one control step the loom is brought into a starting position 52. This process is independent of whether terry or smooth fabric is being manufactured.

During restarting of the machine, the sley control means is drivingly connected with the main shaft of the machine. In order to bring the loom from standstill into the operating condition, one or several lost picks 53 can be effected as the loom runs up to speed, with $VD_{max}$ 54 being set as the loom runs up to speed and with the number of lost picks being freely selectable.

FIG. 4 shows the method sequence during starting of the loom after a previous weft thread breakage. Taking account of the input parameters, and on the basis of the item of information that the first partial beat-up pick is broken, the partial beat-up distance $VD_1$ is set at 55, which is the sum of the target partial beat-up distance $VD_{target}$ plus/minus a correction value $Vk_1$. Thus the first partial beat-up pick is displaced in the warp direction, e.g. in the case of a thin area in the fabric, by a distance greater than the target partial beat-up distance or, in the case of a thick area in the fabric, by a distance which is shorter than the target partial beat-up distance. Following this, the second partial beat-up pick is inserted and the partial beat-up distance $VD_2$ set, which is the sum of the target beat-up distance $VD_{target}$ plus/minus a correction value $Vk_2$. In this way, the second partial beat-up pick is likewise displaced in the warp direction with respect to the target partial beat-up distance $VD_{target}$. During insertion of the full beat-up weft, the beat-up distance $AD_1$ is set at 56, which is the sum of the target full beat-up distance $AD_{target}$ plus/minus a correction value $Ak_1$. In this way, the group of picks is displaced in the warp direction with respect to the target full beat-up distance $AD_{target}$. If the correct position of the group of picks with respect to the fell of the cloth is achieved by means of these correction processes, the further weaving process runs either without additional corrections to the values VD and AD, i.e. the fabric being manufactured has a weft density and loop height with the predetermined values, or with additional corrections for at least one further group of picks having values for VD and AD altered with respect to the group of picks that were previously beaten up. The correction values can have the same or different values.

If the correct position is not achieved, which can be determined on the basis of a visual or automatic monitoring, the values $VD_1$, $VD_2$ and $AD_1$ are altered for the next similar fault event. If a thin area or thick area is detected in the fabric, then the full beat-up distance AD is altered. Specifically, the value of AD is increased in the case of a thin area and the value of AD is decreased in the case of a thick area. If a deviation in the loop height is determined, the values $VD_1$ and $VD_2$ are altered. Specifically, the values of $VD_1$ and $VD_2$ are decreased in the case of a loop which is too high and the values of $VD_1$ and $VD_2$ are increased in the case of a loop which is too low.

In the case of a warp thread breakage, after the loom has been run up to speed, the first pick is generally a full beat-up pick. For this reason, assuming the general case, the course of the method is described in the following.

With a control step "Full beat-up" the correction process is initiated and a beat-up distance $AD_1$ is set, which is the sum of the target full beat-up distance $AD_{target}$ plus/minus a correction value $Ak_1$. In this way, the group of picks is correspondingly displaced in the warp direction by the target full beat-up distance $AD_{target}$. If the correct position of the group of picks with respect to the fell of the cloth is achieved by means of this correction process, the further weaving process runs either without additional corrections to the values VD and AD, i.e. the fabric manufactured afterwards has a weft density and loop height with the specified values, or with further corrections for at least one further group of picks having values for VD and AD altered with respect to the group of picks that were previously beaten up. The correction values can have the same or different values (FIG. 4).

If the correct position is not achieved, which can be determined on the basis of a visual or automatic monitoring, the value is altered. If a thin area or thick area is detected in the fabric, then the full beat-up distance AD is altered, specifically, the value of AD is increased in the case of a thin area and the value of AD is decreased in the case of a thick area.

In the control method the target beat-up distance is altered in the sense of a lengthening or shortening in order to avoid starting marks, for example thick and/or thin areas, so that fabric, for example terry or smooth fabric, is produced with a weft density in accordance with the program.

What is claimed is:

1. A method for controlling the beat-up in a loom and for avoiding start-up blemishes in the fabric due to a stop of the loom after it has woven a length of fabric having warp threads and weft threads and terminating in a last weft thread; the loom having a driven reed reciprocating towards and away from cloth fell for beating-up weft threads against the cloth fell by a desired beat-up distance; the method comprising the steps of:

generating one of a stop signal and a signal indicative of weft yarn breakage;

moving the reed towards the last weft thread over a first distance selected to maintain a sufficient spacing between the reed and the last weft thread of the cloth fell, so as to not disturb the relative position of the last weft thread;

stopping the loom;

restarting the loom;

inserting a first weft thread between the warp threads;

moving the reed against the first weft thread and toward the last weft thread over a second beat-up distance which is different than the first beat-up distance and which is selected so that a predetermined distance remains between the first weft thread and the last weft thread;

inserting a second weft thread between the warp threads;

moving the reed against the second weft thread and toward the last weft thread over the second beat-up distance which is different than the first beat-up distance and which is selected so that a predetermined distance remains between the first weft thread and the last weft thread;

inserting a third weft thread between the warp threads;

moving the reed against the third weft thread and together with the second and first weft thread toward the last weft thread over a third beat-up distance which is selected so that a predetermined distance remains between the first weft thread and the last weft thread;

performing a correction procedure so that after moving the reed over the third beat-up distance, the reed, during subsequent reciprocating movements, is again moved over the desired beat-up distance.

2. A method according to claim 1 wherein the step of stopping the loom occurs after the signal has been generated and before the reed has again been moved over the desired beat-up distance.

3. A method according to claim 1 wherein the third beat-up distance is larger than the desired beat-up distance.

4. A method according to claim 1 wherein the third beat-up distance is less than the desired beat-up distance.

5. A method for weaving a blemish-free fabric following a loom stoppage after a fabric fell terminating in a last weft thread has been woven, the loom including a driven reed reciprocating during normal weaving towards and away from the fell over a predetermined beat-up distance for beating-up the weft threads against the fell, the method comprising the steps of following the loom stoppage moving a next weft yarn towards the last weft yarn over a compensated beat-up distance which is different from the predetermined beat-up distance, and thereafter again moving the reed over the predetermined beat-up distance during subsequent picks of the loom.

6. A method for weaving a blemish-free fabric following a loom stoppage after a fabric fell terminating in a last weft thread has been woven, the loom including a driven reed, the method comprising the steps of: reciprocating the reed over a predetermined beat-up distance towards and away from the fell for beating-up weft threads against the fell, stopping the loom, following the loom stoppage moving a next weft yarn towards the last weft yarn over a compensated beat-up distance which is different from the predetermined beat-up distance, and thereafter again reciprocating the reed over the predetermined beat-up distance during subsequent picks of the loom.

7. A method according to claim 6 wherein the step of moving comprises the step of successively moving a plurality of next weft yarns over compensated beat-up distances which are different from the predetermined beat-up distance.

8. A method according to claim 6 wherein the fabric is a terry fabric, and wherein the step of moving comprises the step of moving first and second weft threads over partial beat-up distances which are each less than the predetermined beat-up distance, and thereafter moving a third weft thread over another beat-up distance which is larger than the partial beat-up distances to therewith move the first and second weft threads an additional beat-up distance, the another beat-up distance being selected so that a predetermined spacing remains between the first weft thread and the last weft thread to position the first weft thread at a predetermined target position relative to the last weft of the fell whereby the formation of fabric blemishes following the loom stoppage is prevented.

* * * * *